United States Patent [19]

Borel

[11] Patent Number: 4,739,803

[45] Date of Patent: Apr. 26, 1988

[54] FABRIC FOR THE SHEET FORMING SECTION OF A PAPERMAKING MACHINE

[75] Inventor: Georg Borel, Reutlingen, Fed. Rep. of Germany

[73] Assignee: Hermann Wangner GmbH & Co., KG, Fed. Rep. of Germany

[21] Appl. No.: 905,424

[22] Filed: Sep. 10, 1986

[30] Foreign Application Priority Data

May 6, 1986 [DE] Fed. Rep. of Germany ..... 3615304

[51] Int. Cl.[4] ..... D03D 25/00

[52] U.S. Cl. ..... 139/383 A; 428/224

[58] Field of Search ..... 139/383 R, 383 A, 425 A; 428/224, 225, 223, 257; 162/348, DIG. 1

[56] References Cited

U.S. PATENT DOCUMENTS

| | | | |
|---|---|---|---|
| 4,564,051 | 1/1986 | Odenthal | 139/383 A |
| 4,592,395 | 6/1986 | Borel | 139/383 A |
| 4,605,585 | 8/1986 | Johansson | 428/224 |

*Primary Examiner*—Henry S. Jaudon

*Attorney, Agent, or Firm*—Sughrue, Mion, Zinn, Macpeak & Seas

[57] ABSTRACT

A fabric for the sheet forming section of a papermaking machine is comprised of an upper and a lower layer of transverse threads interwoven with longitudinal threads. The number of transverse threads in the upper layer is twice as high as that in the lower layer. Within each weave repeat each longitudinal thread is interwoven two times with the upper layer of transverse threads. The transverse threads of the upper layer and the longitudinal threads form crimps disposed in the paper plane. First transverse threads in the upper layer form crimps reaching up to the paper plane which are supported in a crimp saddle of a longitudinal thread, and second transverse threads in the upper layer alternating with the first transverse thread form crimps reaching up to the paper plane which are supported by two adjacent longitudinal threads one of which ascends from the fabric interior to the paper plane while the other one descends from the paper plane into the fabric interior.

2 Claims, 6 Drawing Sheets

FABRIC FOR THE SHEET FORMING SECTION OF A PAPERMAKING MACHINE

BACKGROUND OF THE INVENTION

The invention relates to a fabric for the sheet forming section of a papermaking machine which is made up of a double layer fabric with an upper and lower layer of transverse threads interwoven with longitudinal threads. The transverse threads of the upper layer and the longitudinal threads form crimps oriented towards the paper side with their highest points disposed in the plane of the paper. Within each weave repeat the longitudinal threads are interwoven two times into the upper layer of transverse threads, and the number of transverse threads in the upper layer is twice as high as in the lower layer.

Such double layer sheet forming fabrics are disclosed in German Auslegescrhrifts Nos. 2,263,476; 2,540,490; and 2,706,235, and in European Patent Publication No. 30,490. In the fabric shown in FIG. 2F of German Auslegeschrift No. 2,706,235, the density of transverse threads in the upper layer is likewise twice as high as in the lower layer. Although such sheet forming wires exhibit better marking characteristics than single layer sheet forming wires, they are nevertheless unsuited for the production of paper of the type extremely sensitive to marking.

According to German Auslegeschrift No. 2,706,235, the marking characteristics are improved by extremely long weft floatings, i.e., transverse thread floatings. European Patent Publication No. 30,490, and U.S. Pat. No. 4,333,502, attempt to reach the same goal with long warp floatings.

SUMMARY OF THE INVENTION

The object of the present invention is to provide a fabric for the sheet forming section of a papermaking machine which leaves a minimum of marks on the paper.

According to the invention, this object is achieved by having first transverse threads of the upper layer form crimps reaching up to the paper plane while being supported in a crimp saddle of a longitudinal thread and by having second transverse threads of the upper layer alternating with the first transverse threads to form crimps reaching up to the paper plane while being supported by two adjacent longitudinal threads one of which ascends from the fabric interior to the paper plane, while the other one descends from the paper plane into the fabric interior.

When a transverse thread is supported by the crimp saddle of a longitudinal thread, the longitudinal thread passes underneath the respective transverse thread, while it passes over the preceding and over the next following transverse thread. The transverse thread is affected by a resulting force which is directed upwardly. In the fabric of the invention the first transverse threads of the upper layer are supported in this way. The first transverse threads alternate with second transverse threads in the upper layer. The second transverse threads are supported by adjacent longitudinal threads extending in shear-like fashion, i.e., one of the two longitudinal threads ascends from the fabric interior to the paper plane, while the other one descends from the paper plane into the fabric interior. With such a mode of support a transverse thread is subject not only to a force directed upwardly toward the paper plane, but at the same time to a torque turning it away from the transverse direction in the paper plane.

As a result of these two different types of support of the transverse threads, the transverse thread floats are not all oriented in parallel, and there exist two types of transverse thread floats extending at an angle relative to each other. This eliminates the uniformity of paper marking so that it becomes indistinct and less noticeable.

According to a preferred embodiment of the invention the longitudinal threads directly before and behind each crimp saddle pass over two transverse threads of the upper layer and adjacent longitudinal threads are longitudinally offset relative to one another by six transverse threads in the upper layer. This results in numerous and short longitudinal and transverse thread floats, and thus in a great number of paper sheet supporting points. It has been found that the short longitudinal and transverse floats further improve the freedom from wire marks.

The longitudinal and the transverse threads suitably consist of synthetic resin monofilaments, especially polyester monofilaments. The transverse threads of the lower layer are stronger than those of the upper layer to improve the abrasion resistance. The latter can be further improved by making a number of transverse threads in the lower layer from especially abrasion resistant material, e.g., polyamide.

A monoplanar surface on the paper supporting side is not achieved by the weaving process. Only after thermosetting of the fabric with longitudinal stretching are the uppermost points of the crimps of the longitudinal threads and transverse threads on the paper side disposed in one plane, as is generally known. In a fabric woven from end-to-end, a monoplanar surface generally can be attained more readily than in endless woven fabrics.

The foregoing and other objects, features and advantages of the invention will be apparent from the following more particular description of a preferred embodiment of the invention as illustrated in the accompanying drawings.

DETAILED DESCRIPTION OF THE INVENTION

Figure 1:
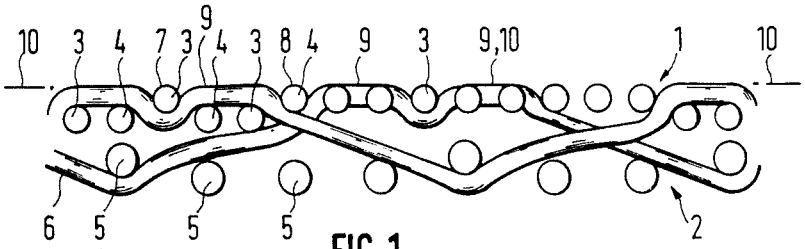
FIG. 1 is a sectional view in longitudinal direction demonstrating the course of two longitudinal threads in a seven harness weave.

As is apparent from the longitudinal fabric section illustrated in FIG. 1 the double layer fabric has an upper layer 1 of first transverse threads 3 and second transverse threads 4 in alternating sequence and a lower layer 2 of transverse threads 5. Longitudinal threads 6 are interwoven with the transverse threads 3, 4 of the upper layer 1 and transverse threads 5 of the lower layer 2 and connect the two layers. The density of the transverse threads in the upper layer 1 is twice that in the lower layer 2 and the fabric is woven in such a way that the second transverse threads 4 of the upper layer 1 come to lie as exactly as possible above the transverse threads 5 of the lower layer 2.

Within each weave repeat each longitudinal thread 6 is interwoven twice into the upper layer 1 in that it passes in succession over two transverse threads 3, 4 under a first transverse thread 3 and again over two transverse threads 3, 4. Within the upper layer 1 the longitudinal thread 6 thus forms a saddle which supports a first transverse thread 3 on which substantially only an upwardly directed force is exerted. Thereafter the longitudinal thread 6 passes between the two layers 1, 2 a distance of four transverse threads 3, 4 in the upper layer 1 and two transverse threads 5 in the lower layer 2 so that it is interwoven also with the lower layer 2. Then it passes once more between the two layers 1, 2 until it again ascends to the top side within the next following weave repeat.

Thermosetting of the fabric under longitudinal tension causes the topmost points of the crimps 7 of the first transverse threads 3, the crimps 8 of the second transverse threads 4 and the crimps 9 of the longitudinal threads 6 to be disposed in the paper plane 10. The longitudinal tension exerted during thermosetting of the fabric also somewhat lifts the transverse thread 5 of the lower layer 2 under which the longitudinal thread 6 passes, so that the lowermost point of the crimp formed by the longitudinal thread 6 in the lower layer 2 is disposed somewhat above the running side formed by the other transverse threads 5 of the lower layer 2 and is thus largely protected against abrasion. Hence the fabric represents a so-called transverse thread runner (weft runner with open end weave).

Figure 2:
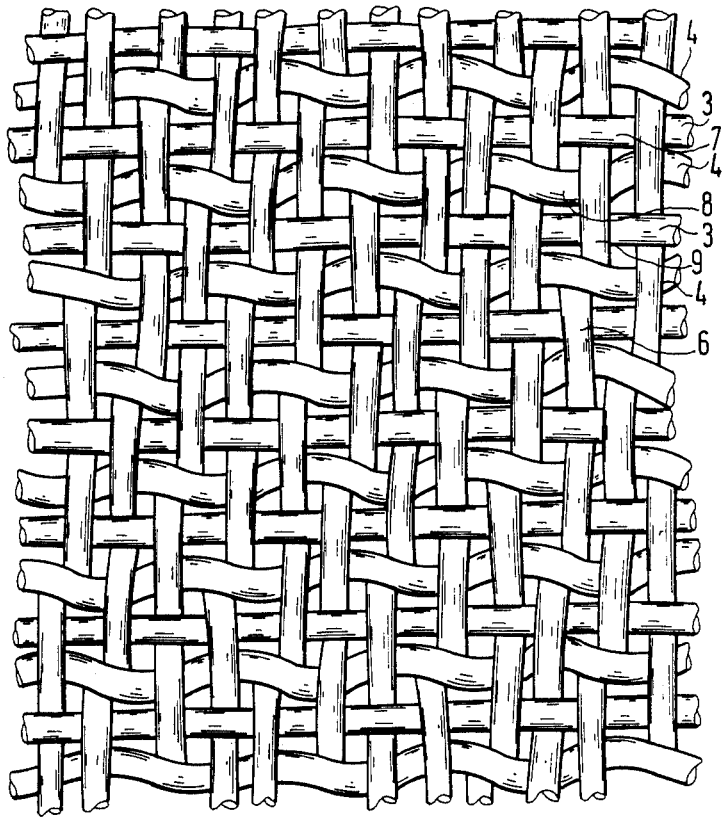
FIG. 2 is a plan view of the fabric shown in FIG. 1.

According to FIG. 2, adjacent longitudinal threads are longitudinally offset by a distance corresponding to six transverse threads 3, 4 each in the upper layer 1. As is apparent in FIG. 1, adjacent longitudinal threads 6 therefore cross beneath a second transverse thread 4 of the upper layer 1. This results in a a shear-like support of said second transverse thread 4 whereby the second transverse thread 4 is not only urged upwardly but is at the same time twisted in the transverse direction in the fabric plane. The crimps 8 of the second transverse threads therefore are not disposed parallel to the crimps 7 of the first transverse threads 3 in the upper layer 1.

Figure 3:
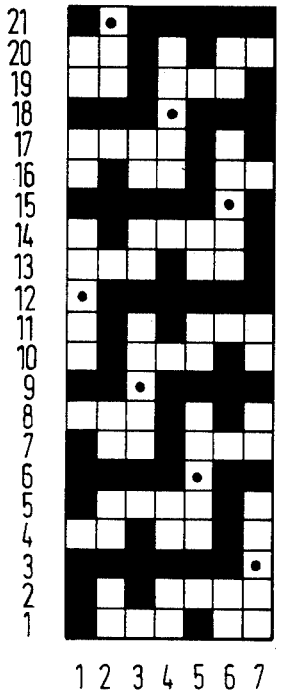
FIG. 3 is a schematic diagram showing the weave design for the fabric shown in FIGS. 1 and 2.

The fabric weave of FIGS. 1–3 is a seven harness weave as it repeats after seven transverse threads 5 in the lower layer 2 and seven longitudinal threads 6. Hence a weave repeat comprises seven transverse threads 5 in the lower layer 2 and seven longitudinal threads 6 and fourteen transverse threads 3 and 4 in the upper layer 1. The first transverse threads 3 and the second transverse threads 4 can be made of the same material and can have equal dimensions. For the second transverse threads 4 preferably a softer material is selected, suitable in connection with a larger diameter, in order that the crimps 8 of said transverse threads 4 extend at a wider angle to the transverse direction which may be beneficial to freedom from wiremarks.

Figure 6:
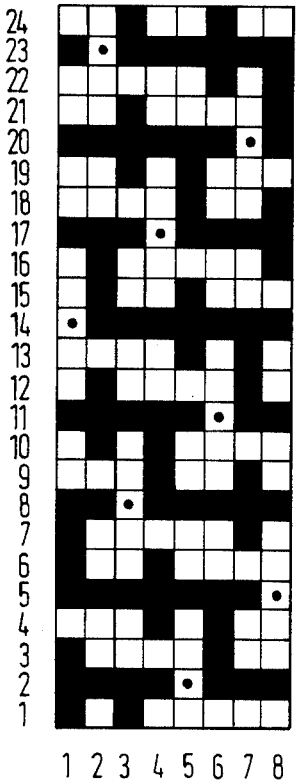
FIGS. 4–6 are views analogous to those shown in FIGS. 1 to 3, but for an eight harness weave.
Figure 5:
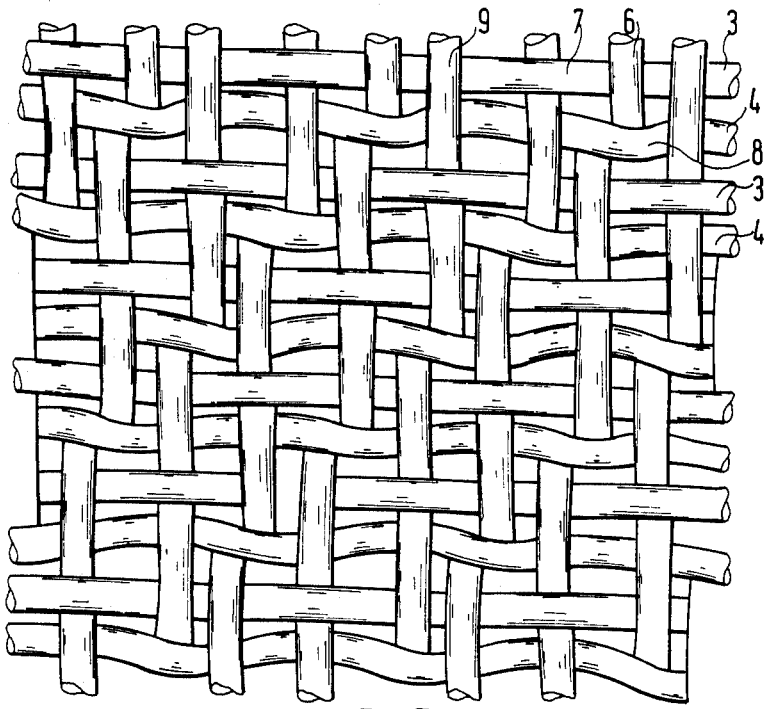
Figure 4:
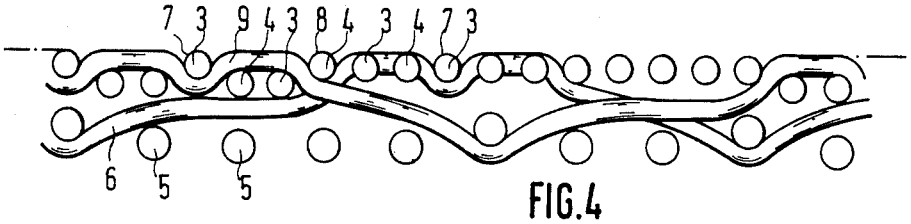

FIGS. 4–6 show an example analogous to that of FIGS. 1–3, but for an eight harness weave. Each longitudinal thread again forms two crimps 9 in the upper layer 1 separated by a first transverse thread 3 which in this place forms crimp 7 extending in the transverse direction.

The crimps 8 of the second transverse threads 4 again extend at an angle to the transverse direction since the second transverse threads 4 are supported shear-like by adjacent longitudinal threads 6 offset relative to each other by six transverse threads. A comparison of FIGS. 2 and 5 demonstrates that the crimps 9 of the longitudinal threads 6 are very uniformly distributed. On the other hand, the crimps 7 and 8 extending obliquely relative to each other to counteract the monotony of pattern and especially do not form any diagonally extending lines which leave a mark on the paper.

It is also possible to separate the two crimps 9 of each longitudinal thread 6 by three or five transverse threads 3 in the upper layer 1 rather than by one transverse thread 3. In case of separation by three transverse threads the two different types of crimps extending obliquely to each other are formed in each transverse thread of the upper layer 1. In case of separation of the crimps 9 by five transverse threads of the upper layer the transverse threads float over four longitudinal threads and there is only one type of crimp so that this does not lead to a further improvement in the reduction of papermarks.

FIGS. 3 and 6 show the weave designs for the examples illustrated by FIGS. 1, 2 and 4, 5, respectively. The numbers 1 to 7 in FIG. 3, and 1 to 8 in FIG. 6 along the lower margin designate the longitudinal threads, and the numbers 1 to 21 and 1 to 24, respectively, along the lateral margin designate the transverse threads of one weave repeat.

In FIG. 3 the transverse threads numbered 1, 4, 7, 10, etc., relates to the first transverse threads 3 supported by a crimp saddle of one longitudinal thread, while the transverse threads numbered 2, 5, 8, etc., related to the second transverse threads 4 are supported in shear fashion by longitudinal threads. The transverse threads numbered 3, 6, 9, etc., represent transverse threads 5 of the lowrer layer 2. In FIG. 6 the transverse threads numbered 2, 5, 8, 11, etc., belong to the lower layer, while the first transverse threads 3 numbered 1, 4, 7, etc., are supported by crimp saddles and second transverse threads 4 supported in a shear-like manner are numbered 3, 6, 9, etc.

Each individual square of the weave design represents a crossing point between a longitudinal and a transverse thread. Black squares indicate that the longitudinal thread passes over the transverse thread while white squares indicate that the transverse threads of the upper layer 1 pass over the longitudinal thread 6. The squares marked with a black dot indicated that the transverse threads of the lower layer 2 are disposed above the longitudinal threads 6, when viewed from the paper side. These are the points of interweaving between the lower layer 2 and the longitudinal threads 6.

The fabric of the invention is generally woven and thermoset in such a way that the longitudinal thread density ranges between 90 and 110 percent. A typical value for the longitudinal thread density ranges between 100 and 105 percent. However, for tissue paper suitably lower values are selected.

Figure 7:
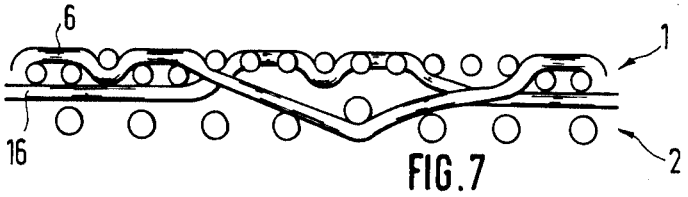
FIG. 7 is a longitudinal sectional view of an embodiment of the papermaking machine fabric in which a number of the longitudinal threads are interwoven only with the upper layer.
Figure 8:
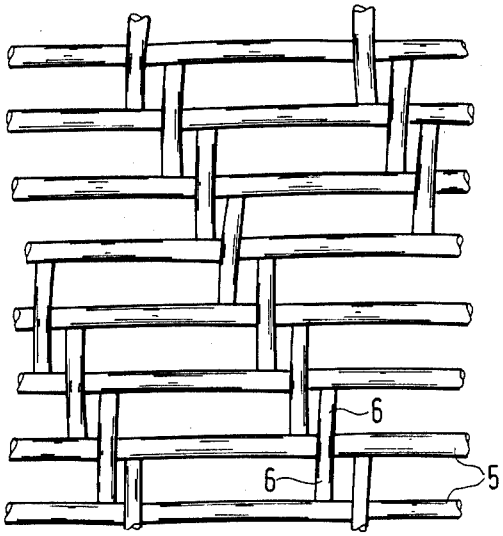
FIG. 8 is a plan view of the fabric in FIG. 7 as viewed from the bottom or running side.

The presently described papermaking machine fabric can, according to European Patent Publication No. 48,962, also be produced in such a way that only a portion of the longitudinal threads 6 is interwoven with the lower layer 2 of transverse threads 5 while the other longitudinal threads 16 are interwoven only with the weft threads 3, 4 of the upper layer 1 so that they are not subject to abrasion on the running side. Such embodiments of the papermaking machine fabric of the present invention are shown in section in FIGS. 7 and 9. The embodiment shown in FIG. 7 is largely identical with that of FIG. 1 and the only difference resides in the fact that every second longitudinal thread 16 is not interwoven with the lower layer 2. Also another ratio of longitudinal threads 6 to longitudinal threads 16 can be selected. Within each weave repeat the longitudinal threads 6 are interwoven twice with the upper layer 1 and once with the lower layer 2. Within each weave repeat the longitudinal threads 16 are interwoven twice with the upper layer 1 but never with the lower layer 2. This results in very long transverse thread floats on the running side extending over 13 longitudinal threads, as shown in FIG. 8. On the paper side there is no difference from the embodiment of FIGS. 1 and 2.

Figure 9:
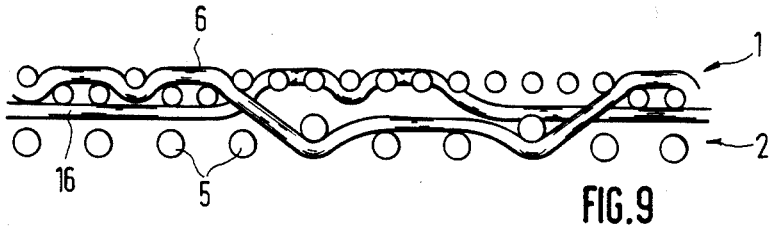
FIG. 9 is a longitudinal sectional view of another embodiment similar to that of FIGS. 7 and 8 but for a higher harness weave.
Figure 10:
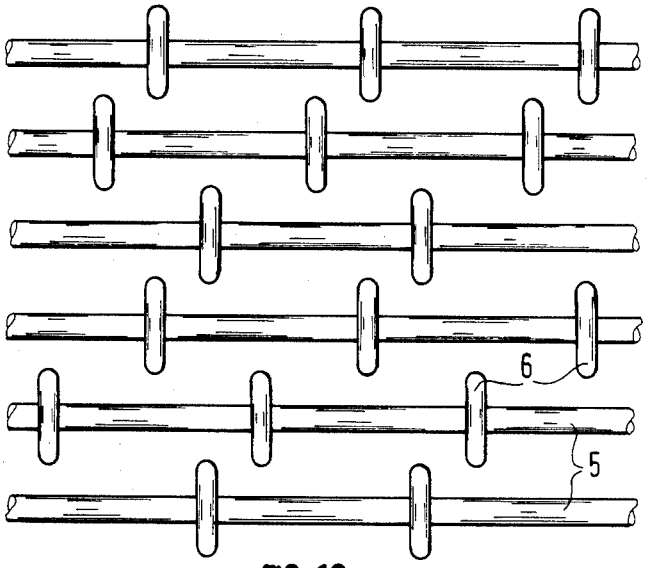
FIG. 10 is a plan view of the fabric shown in FIG. 9.
Figure 11:
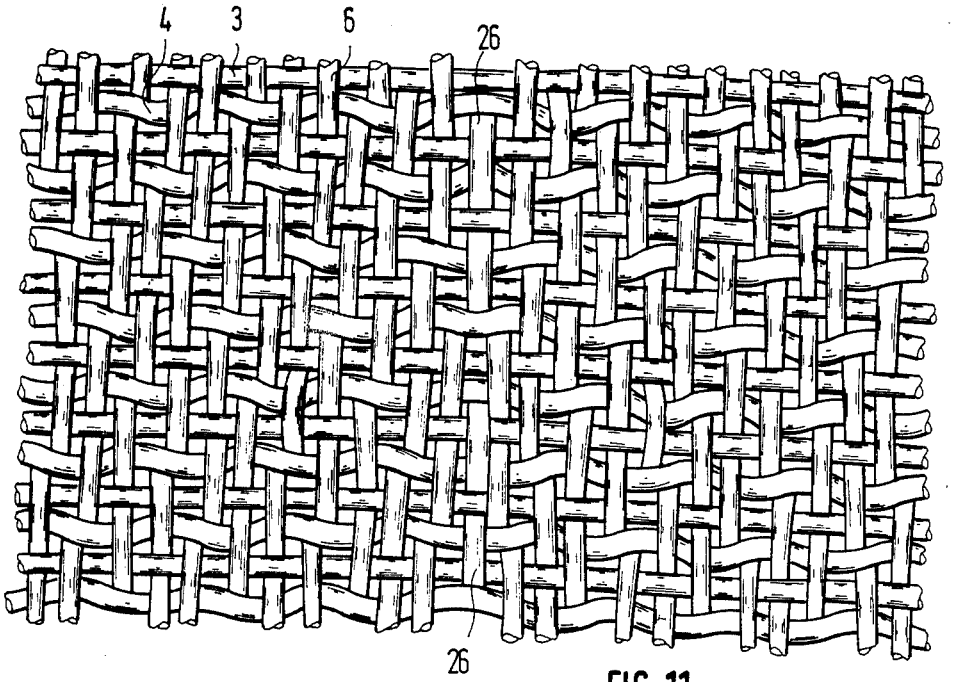
FIG. 11 is a plan view of a papermaking machine fabric with mirror symmetrical weave pattern in the two fabric halves.

FIGS. 9 and 10 show an embodiment of the papermaking machine fabric in which the warp threads 6 are interwoven twice with the upper layer 1 and twice with the lower layer 2. The other longitudinal threads 16 are interwoven twice with the upper layer 1 but never with the lower layer 2. This results in shorter floats on the running side, viz. over 7 longitudinal threads, as shown in FIG. 10. The paper face of this embodiment corresponds with that of FIGS. 4 and 5 since there are no differences with respect to interweaving into the upper layer 1. According to European Patent Publication No. 120,337 the paper making machine fabric of the present invention can be made such that the weave pattern is mirror-image symmetrical in the two fabric halves on either side of the longitudinal center line and the points of interweaving form a V pattern in the fabric with a weave diagonal interrupted in the middle of the fabric. This prevents lateral running or drifting of the travelling papermaking fabric in the papermaking machine. Additional longitudinal threads 26 in the fabric center prevent exessively long floats of the transverse threads so that along the borderline between the two fabric halves there are no substantially longer floats of the transverse threads than in the remaining fabric. FIG. 11 shows in plan view a section of such a papermaking machine fabric including several additional longitudinal threads 26.

Figure 12:
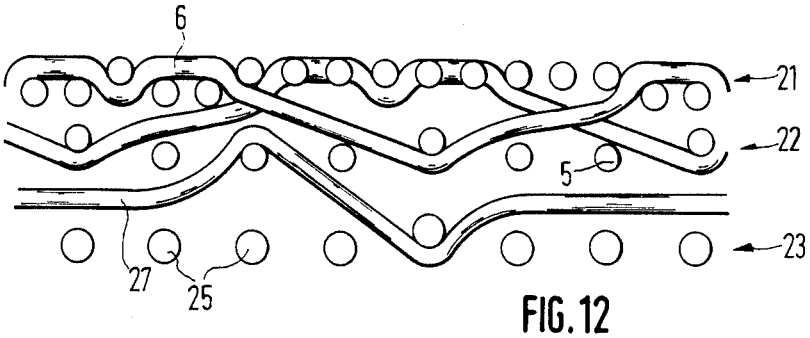
FIG. 12 is a longitudinal sectional view of a papermaking machine fabric comprising three layers of transverse threads.

FIG. 12 shows in longitudinal section an embodiment in which three layers of transverse threads are provided. The top layer 21 and the intermediate layer 22 of transverse threads are interwoven with the longitudinal threads 6 as shown in FIG. 1 for the upper layer 1 and the lower layer 2.

The lower layer 23 of transverse threads in FIG. 12 is an additional layer of transverse threads 25 interwoven by additional longitudinal threads 27 with the intermediate layer 22 of transverse threads 5. On the whole, each longitudinal thread is interwoven only with the transverse threads of two adjacent layers. Suitably the density of the transverse threads 25 of the lower layer 23 is the same as that of the transverse threads 5 of the intermediate layer 22. Such a composite fabric is described in detail in German Auslegeschrift No. 3,225,599. The paper face of this embodiment is the same as that shown in FIG. 2.

EXAMPLE 1

A fabric with a seven harness weave according to FIGS. 1 to 3 is made by open end weaving. The longitudinal threads consist of polyester monofilament having a high elastic modulus and a diameter of 0.15 mm. After thermosetting the longitudinal thread density is 71 threads/cm.

The first transverse threads 3 of the upper layer 1 are polyester monofilaments of 0.17 mm diameter and have an average elastic modulus (elongation 19% under a load of 27 cN/tex). The second transverse threads 4 are polyester monofilaments of 0.185 mm diameter and have a relatively low elastic modulus (elongation 23.4% under a load of 27 cN/tex). After thermosetting the density of transverse threads in the upper layer 1 is 36/cm.

The transverse threads 5 of the lower layer 2 forming the running side are especially soft polyester monofilaments (elongation 23.4% under a load of 27 cN/tex) of 0.20 mm diameter alternating with soft polyamide 6 monofilaments of 0.21 mm diameter, and after thermosetting the density of transverse threads in the lower layer 2 is 18/cm.

The fabric is thermoset in such a way that on the paper face the crimps 7 and 8 of the first transverse threads 3 and of the second transverse threads 4 and the crimps 9 of the longitudinal threads 6 are disposed in one plane so that the fabric is monoplanar. On the running side there was a monoplanity differential between the transverse threads 5 and the longitudinal threads 6 of 7.5/100 mm so that the fabric is a weft runner. During weaving and setting care was taken that the second transverse threads 4 of the upper layer 1 are disposed exactly above the transverse threads 5 of the lower layer 2.

EXAMPLE 2

A fabric of an eight harness weave as shown in FIGS. 3–6 is produced by open end weaving and, after setting, it is made endless by means of a woven seam. The fabric is woven with a longitudinal thread count of 54/cm. During thermosetting the longitudinal thread count increased to a value of 60/cm due to the transverse contraction of the fabric. The longitudinal threads consist of polyester monofilament of 0.17 mm diameter of a longitudinal stabilized quality with high elastic modulus.

The transverse threads 3 of the upper layer consist of polyester monofilament of 0.17 mm diameter of a relatively hard weft quality Trevira Type 902 with an elastic modulus relatively high for weft wires corresponding to an elongation of 8.5% under a load of 27 cN/tex). The second weft threads 4 of the upper layer 1 are likewise polyester monofilaments, but of the softer Trevira Type 900 with an elongation of 23.4% at 27 cN/tex and a diameter of 0.20 mm. This fabric is woven with a transverse thread density of 35/cm and after thermosetting the transverse thread count is reduced to 32/cm in the upper layer 1 and to 16/cm in the lower layer 2. The transverse threads 5 in the lower layer 2 are polyester monofilaments of 0.22 mm diameter of the soft Trevira Type 900 corresponding to an elongation of 23.5% at 27 cN/tex alternating with polyamide monofilaments of the PA Type 6.6 with a diameter of 0.24 mm. The fabric is set at 195° C. and during this operation a maximum longitudinal tension of 95 N/cm is reached. During setting a crimp reversal between longitudinal and transverse threads takes place. The longitudinal warp threads originally disposed on the outside of the woven fabric stretch under the influence of the setting tension and heat and, as a result of this crimp reversal, are embedded in the interior of the fabric. In the final fabric the longitudinal thread floats and the floats of the first transverse thread 3 and the second transverse threads 4 on the paper side are all disposed in one plane. On the running side the longitudinal thread 6 forces the transverse threads 5 to form distinct crimps so that in the final fabric solely the floats of the transverse threads 5 form the external side, i.e., the running side, of the fabric in the lower layer 2. On the running side differences in height between the transverse threads and the longitudinal threads of 8.5/100 mm are measured, i.e. only after 8.5/100 mm of the transverse thread material have been abraded do the longitudinal threads 6 for the first time get in contact with the elements of the wire section of the papermaking machine.

While the invention has been particularly shown and described with reference to preferred embodiments thereof it will be understood by those in the art that the foregoing and other changes in form and details may be made therein without departing from the spirit and scope of the invention.

What is claimed is:

1. A fabric for the sheet forming section of a papermaking machine, said fabric comprising an upper and a lower layer of transverse threads interwoven with longitudinal threads with twice as many transverse threads in the upper layer as in the lower layer, within each weave repeat each longitudinal thread being interwoven two times with the upper layer of transverse threads and the transverse threads of the upper layer and the longitudinal threads forming crimps disposed in the paper plane wherein the first transverse threads of the upper layer form crimps which reach up to the paper plane and are supported in a crimp saddle of a longitudinal thread and second transverse threads of the upper layer alternating with the first transverse threads form crimps which reach up to the paper plane and are supported by two adjacent longitudinal threads one of which ascends from the fabric interior to the paper plane while the other one descends from the paper plane into the fabric interior so that a torque is exerted on the second transverse threads turning them out of the transverse direction in the paper plane, wherein the longitudinal threads pass over two transverse threads of the upper layer directly before and behind each crimp saddle, and adjacent longitudinal threads are longitudinally offset by a distance corresponding to six transverse threads of the upper layer relative to each other.

2. A fabric according to claim 1 wherein the lower layer comprises at least a seven harness weave.

* * * * *